US007553347B2

(12) United States Patent
Burnham

(10) Patent No.: US 7,553,347 B2
(45) Date of Patent: Jun. 30, 2009

(54) DUST SEPARATOR/COLLECTOR ASSEMBLY FOR SUCTION CLEANER

(75) Inventor: Gavin Burnham, Sheldon (GB)

(73) Assignee: VAX Limited, Droitwich (GB)

( * ) Notice: Subject to any disclaimer, the term of this patent is extended or adjusted under 35 U.S.C. 154(b) by 605 days.

(21) Appl. No.: 11/375,722

(22) Filed: Mar. 15, 2006

(65) Prior Publication Data

US 2006/0236665 A1 Oct. 26, 2006

(30) Foreign Application Priority Data

Apr. 21, 2005 (GB) ..... 0508017.1

(51) Int. Cl.
*B01D 45/12* (2006.01)

(52) U.S. Cl. ..... 55/349; 55/429; 55/459.1; 55/DIG. 3; 15/350; 15/353

(58) Field of Classification Search ..... 55/346, 55/349, 429, 459.1, DIG. 3; 15/350, 353
See application file for complete search history.

(56) References Cited

U.S. PATENT DOCUMENTS

| | | | | |
|---|---|---|---|---|
| 2,346,339 | A | | 4/1944 | Vose |
| 5,078,761 | A | | 1/1992 | Dyson |
| 5,125,127 | A | | 6/1992 | Bach et al. |
| 5,135,552 | A | | 8/1992 | Weistra |
| 5,309,600 | A | * | 5/1994 | Weaver et al. ..... 15/328 |
| 5,351,362 | A | | 10/1994 | Kramer et al. |
| 5,500,979 | A | | 3/1996 | Wörwag |
| 5,787,546 | A | | 8/1998 | Bass et al. |
| 5,960,514 | A | | 10/1999 | Miller et al. |
| 6,058,559 | A | | 5/2000 | Yoshimi et al. |
| 6,350,292 | B1 | | 2/2002 | Lee et al. |
| 6,572,668 | B1 | | 6/2003 | An et al. |
| 6,662,403 | B2 | | 12/2003 | Oh |
| 2002/0011053 | A1 | | 1/2002 | Oh |
| 2002/0062632 | A1 | | 5/2002 | Oh |
| 2002/0088078 | A1 | | 7/2002 | Oh et al. |
| 2002/0120998 | A1 | | 9/2002 | Dubos et al. |
| 2002/0124538 | A1 | | 9/2002 | Oh et al. |
| 2003/0106182 | A1 | | 6/2003 | Lee |
| 2003/0106183 | A1 | | 6/2003 | Frederick et al. |

FOREIGN PATENT DOCUMENTS

| | | |
|---|---|---|
| DE | 38 34 686 C1 | 12/1989 |
| DE | 94 20 797.6 U1 | 7/1995 |
| DE | 29500994 U1 | 5/1996 |
| DE | 299 00 460 U1 | 8/2000 |

(Continued)

OTHER PUBLICATIONS

European Search Report for Application No. 06251679.4, dated Oct. 25, 2007, 6 pgs.

(Continued)

*Primary Examiner*—Robert A Hopkins
(74) *Attorney, Agent, or Firm*—Michael Best & Friedrich LLP

(57) ABSTRACT

A separator/collector assembly (50) able to be installed in relation to a body (51) of a suction cleaner, the separator/collector assembly providing storage for a suction hose which can be deployed for use when required.

14 Claims, 3 Drawing Sheets

FOREIGN PATENT DOCUMENTS

| | | | |
|---|---|---|---|
| DE | 199 14 574 | C1 | 11/2000 |
| DE | 101 10 771 | A1 | 9/2002 |
| EP | 0740922 | A1 | 11/1996 |
| EP | 1 386 573 | A2 | 2/2004 |
| EP | 1547511 | A | 6/2005 |
| FR | 2 425 227 | | 12/1979 |
| GB | 2 128 075 | A | 4/1984 |
| GB | 2 367 510 | A | 4/2002 |
| GB | 2388527 | A | 11/2003 |
| WO | WO 98/35602 | A1 | 8/1998 |
| WO | WO 2004/049887 | A1 | 6/2004 |
| WO | WO 2004/049889 | | 6/2004 |
| WO | WO 2004/049890 | A1 | 6/2004 |
| WO | WO 2004/052166 | A1 | 6/2004 |

OTHER PUBLICATIONS

Pending U.S. Appl. No. 11/187,414, filed Jul. 22, 2005, 23 pages.
Pending U.S. Appl. No. 11/217,584, filed Aug. 31, 2005, 17 pages.
Pending U.S. Appl. No. 29/240,051, filed Oct. 7, 2005, 6 pages.
Pending U.S. Appl. No. 29/240,115, filed Oct. 7, 2005, 6 pages.
Pending U.S. Appl. No. 29/240,116, filed Oct. 7, 2005, 5 pages.
Pending U.S. Appl. No. 29/240,117, filed Oct. 7, 2005, 7 pages.
Pending U.S. Appl. No. 29/240,118, filed Oct. 7, 2005, 7 pages.
Pending U.S. Appl. No. 10/537,537, filed Nov. 10, 2005, 21 pages.
Pending U.S. Appl. No. 11/273,094, filed Nov. 14, 2005, 17 pages.
Pending U.S. Appl. No. 10/537,381, filed Nov. 14, 2005, 25 pages.
Pending U.S. Appl. No. 10/537,382, filed Nov. 14, 2005, 33 pages.
Pending U.S. Appl. No. 10/537,481, filed Nov. 14, 2005, 14 pages.
Pending U.S. Appl. No. 11/329,194, filed Jan. 10, 2006, 23 pages.

* cited by examiner

DUST SEPARATOR/COLLECTOR ASSEMBLY FOR SUCTION CLEANER

DESCRIPTION OF INVENTION

This invention relates to suction cleaners (vacuum cleaners) and more particularly to a separator/collector assembly for separating entrained dust, dirt and other matter (all herein referred to as "dust") from the suction air flow created by the cleaner, and retaining such separated dust for later disposal.

The separator/collector assembly for a suction cleaner usually is removeable as a whole from a body part of the cleaner. The body part of the cleaner is provided with a source of suction (a motor and impeller) to create the suction air flow, and when the separator/collector assembly is in position relative to the body part an outlet passage for flow of air from which dust has been separated communicates with the passage leading to the source of suction. It has been proposed that different types of separator/collector assembly can be fitted to a common body part of a cleaner, for example, to enable the substitution of a separator/collector assembly of the "cyclonic" type for one of the "bagged" or "filter" type. In the latter, as its name implies, the separation is effected by a filter which may be in the form of a bag (reuseable or disposable) permeable to the air flow and in which the separated dust is retained. Alternatively a filter element may be provided in the path for air flow through a chamber in which dust separated by the filter is retained. Separators of the cyclonic type cause the dust-laden air flow to flow in a helical path in a cyclone body, causing separation of the dust by centrifugal forces. Cyclonic separator/collector assemblies may also include a filter or filters.

Suction cleaners are known which provide for the sucking-up of liquids, eg. to clear spillages or as part of a cleaning operation. To separate liquid from the suction air flow drawn to a cleaner, and to retain such liquid for disposal, a separator/collector assembly is required which is of somewhat different design from that for a cleaner intended to deal with dry dust only: the use of filter elements, whose function will be impaired if they become wet, is to be avoided in any positions where they might come into contact with liquid, and the passage of any liquid beyond the separator/collector to the source of suction of the cleaner must be avoided. Thus separate separator/collector assemblies, of different design from one another, may be provided for when a cleaner is to be used for wet and dry conditions.

A further factor to be taken into consideration when the operation of a cleaner for the collection of both wet and dry materials is concerned is that certain accessories of the cleaner must be suitable for the respective conditions. In particular, a hose, by which the suction air flow is conducted from an inlet at which the material is ingested, has to be suitable for wet or dry conditions. Extendible hoses are frequently used in relation to suction cleaners (either of the upright or cylinder type), such hoses being able to be extended lengthways when subject to tension. This enables a hose to be easily stored when not extended, but be able to be used for cleaning purposes at a reasonable distance from the body of the cleaner when it is extended. However, such an extendible hose is not suitable for the passage of liquid, because when the hose is contracted, liquid becomes trapped between the folds of the hose. Also, an extendible hose is unsuitable for use where liquid is required to be supplied from the cleaner to a cleaning head for use in carpet or upholstery cleaning, (such liquid then being sucked from whatever has been cleaned and returned to a used-liquid receptacle in the cleaner so that the cleaned object is not left too wet), because the tube delivering liquid to the cleaning head would also have to be extendible and this is difficult to design. An extendible hose also is not well suited to the provision of means for delivering electrical power to a cleaning head by way of the hose, e.g. to power a brush or beater bar in the head.

It is broadly the object of the present invention to provide a separator/collector assembly which is suitable for use in a machine for dry vacuuming.

According to one aspect of the invention, we provide a separator/collector assembly able to be installed in relation to a body of a suction cleaner, wherein the assembly provides storage for a suction hose which can be deployed from the assembly when required to be used.

The hose preferably is extendible lengthways when subject to lengthways tension, and when in a non-extended condition is able to be entirely or substantially entirely accommodated in a hose-storage space provided in the separator/collector assembly. A separator/collector assembly having such a hose is of course best suited, and intended for use, under dry conditions.

The hose may be accommodated, when contracted, in the storage space of the assembly in a generally sinuous configuration. To this end, there may be guide means for causing the hose to assume a generally S-shaped configuration in the storage space. Such guide means may comprise, for example, a pivotable member having respective spaced formations around which the hose assumes its generally S-shaped configuration.

The pivotable member may be spring-biased to pivot so as to cause the hose to assume its generally S-shaped configuration. The formations on the pivotable member may comprise rollers.

The storage space for the hose may be afforded by a mid-region of the separator/collector assembly, having spaces on opposite sides of the storage space which provide for collection of separated dust therein.

The separator/collector assembly may comprise at least one cyclonic separating device. There may be two such cyclonic separating devices, connected, in air flow terms, in parallel with one another. Each separating device may discharge separated dust to the respective dust-collection space on either side of the hose storage space in the assembly.

In a separator/collector assembly in accordance with the invention, the storage of the suction hose in the separator/selector assembly means that a suction hose of a type compatible with the sort of cleaning for which the particular type of separator/collector assembly is intended becomes possible. Further, a "modular" design of a range of suction cleaners can be achieved, utilising a common body and different separator/collector assemblies, and hoses, for different intended cleaning tasks.

For example, there may be a separator/collector assembly intended for "wet" use, e.g. carpet cleaning or spill pick-up, provided with a separating device or devices suitable for dealing with entrained liquids and to which a suitable hose of non-extendible type can be connected, and a separator/collector assembly for "dry" use, in accordance with the invention. A cleaner to which such separator/collector assemblies fit may be suitable for both types of use, without requiring any modifications other than the replacement of the separator/collector assembly. Thus a manufacturer can offer a range of machines for different usages, utilising many common parts with only the separator/collector assembly being changed for different machines in the range.

The invention will now be described by way of example only with reference to the accompanying drawings, of which FIG. 1 is a diagrammatic perspective illustration of a separator/collector assembly in accordance with the invention;

Figure 1:
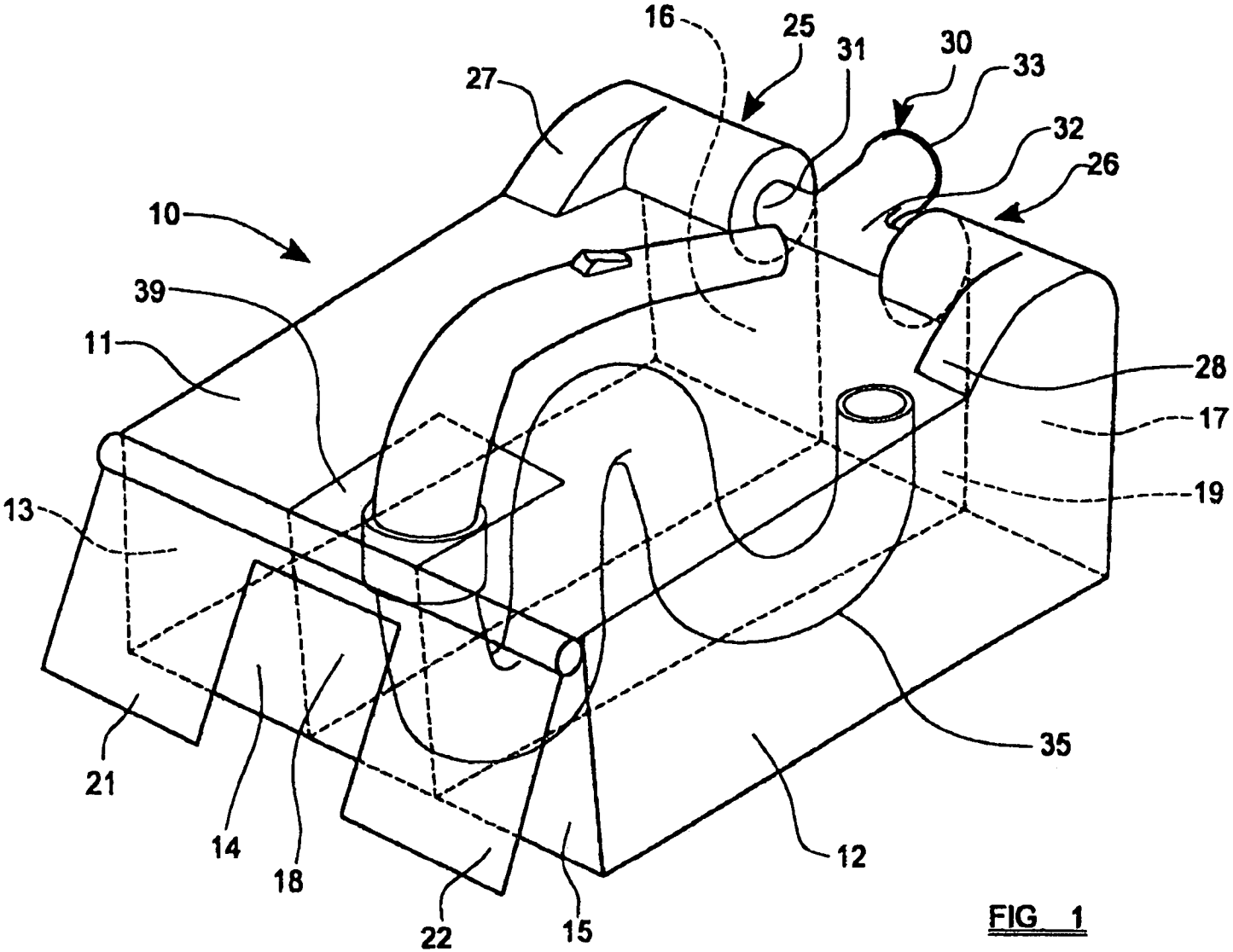

Referring firstly to FIG. 1 of the drawings, the illustrated separator/collector assembly is a somewhat rectangular (in plan view) box-like device, comprising a hollow body indicated generally at 10 which has a top wall 11, spaced generally parallel side walls 12, 13, a bottom wall which is in two parts 14, 15 respectively adjacent the side walls 12, 13, and a back end wall also in two parts 16, 17 respectively. Between the side walls 12, 13 there are two spaced upwardly extending intermediate walls 18, 19 so that there are two box-like dust receiving parts, spaced from one another with a gap therebetween, respectively adjacent the side walls 11, 12.

At the end of the assembly opposite the back end wall 16, 17, the dust-receiving parts are closed by respective parts 21, 22 of a door, pivoted to the assembly at its upper edge and arranged to be held closed by a catch and released from such catch to be opened when it is required to empty dust from the dust-receiving parts of the assembly.

Where the end wall parts 16, 17 join the top wall 11, there are two cyclonic separators whose axes, about which helical airflow takes place to separate dust from the air flow, are in line with one another and horizontally orientated. These separators 25, 26 have tangential inlet passages at their adjacent ends, in the lower part thereof and therefore not visible in the drawing. At their respective opposite ends, remote from one another, there are tangential dust outlet passageways, parts of which are visible at 27, 28 formed in the top wall of the separator/collector assembly. The outlets for air from which dust has been cyclonically separated in the separators face one another at the adjacent ends of the separators 25, 26 and a T-shaped outlet member indicated generally at 30 has oppositely facing portions 31, 22 which extend into the two separators to provide the air outlets. When the separator/collector assembly is in place in a suction cleaner, the free end 33 of the T-shaped outlet member 30 faces and engages a passage leading to the source of suction of the cleaner.

The space between the intermediate walls 18, 19 of the assembly accommodates a suction hose which is of the type which is extendible in its length when subject to lengthwise tension. As visible in FIG. 1, substantially all the hose 35 is able, when not subject to any lengthways extension, to be accommodated in the space between the walls 18, 19.

Figure 2:
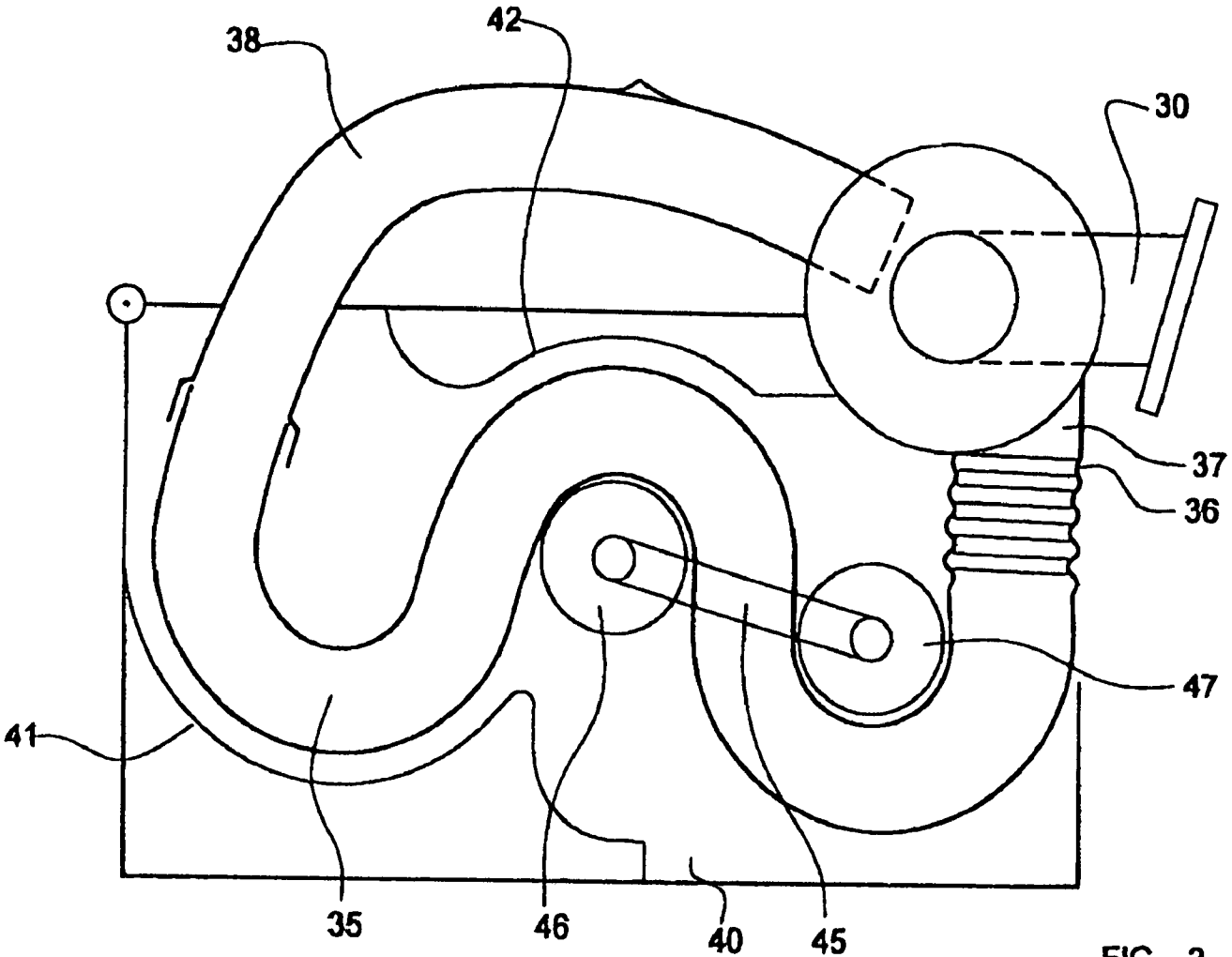
FIG. 2 is a transverse section through the assembly of FIG. 1.

Referring now additionally to FIG. 2 of the drawings, this illustrates, in a diagrammatic section taken parallel to the intermediate walls 18, 19, the hose 35 when fully contracted, i.e. not subject to any lengthwise extension, accommodated in the space between the walls. One end of the hose 36 is connected to a member 37 which affords a passage which divides to lead into inlets of the two cyclonic separators 25, 26. The shape of one of the cyclonic separators is visible in FIG. 2, together with the outlet member 30 therefrom. The opposite end of the hose from its captive end 36 is connected to a tubular handle 38 which extends out of an opening 39 in the top wall 11 and is adapted for connection to a cleaning tool of any appropriate type, possibly with the interposition of a rigid, fixed length or extendible, wand. When accommodated in the space (40) between the walls 18, 19, the hose 35 assumes a sinuous configuration and is guided to assume this configuration by guide members 41, 42. These ensure that when the hose contracts it is readily fed back into the space 40 through the hole 39 in the top wall 11, and is equally readily deployed therefrom when subject to lengthwise tension when it is to be used. Further guidance may be provided by a pivotally moveable arm member 45 which has guide rollers 46, 47 at its opposite ends and whose pivotal movement is spring biased to assume the position illustrated in FIG. 2 in which it causes the hose to adopt the illustrated sinuous configuration. When the hose is deployed from the space 41, however, by subjecting it to lengthwise tension, the arm 45 will pivot against the force exerted by its biasing spring, enabling the part of the hose within the space 41 to assume a more nearly straight configuration.

The separator/collector assembly above described is, by virtue of utilising an extendible hose, best suited and intended for "dry" use. It may be installed in relation to a suction cleaner body to provide a suction cleaner for dry cleaning. A different type of separator/collector assembly would make the cleaner suitable for "wet" cleaning, e.g. for sucking-up liquid spills or as part of a carpet or upholstery cleaning operation. The provision of such different types of separator/collector assembly usable with a common cleaner body would enable a manufacturer to achieve design and manufacturing economies in the supply of a range of machines for different uses.

Figure 3B:
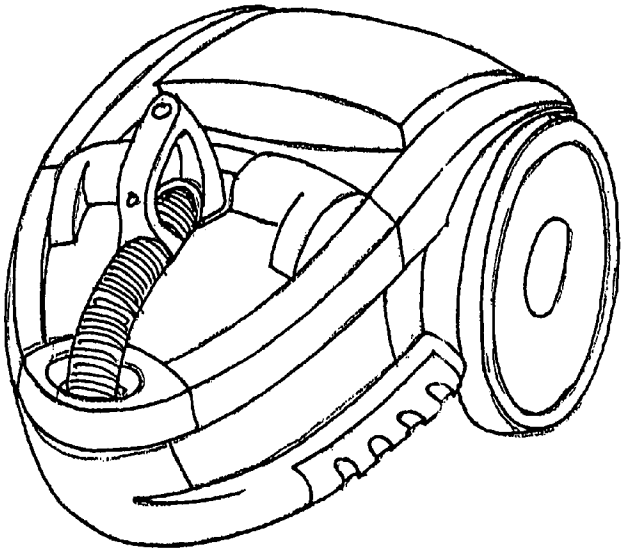
FIG. 3 illustrates diagrammatically how a separator/collector assembly in accordance with the invention may fit to a body of a vacuum cleaner.
Figure 3A:
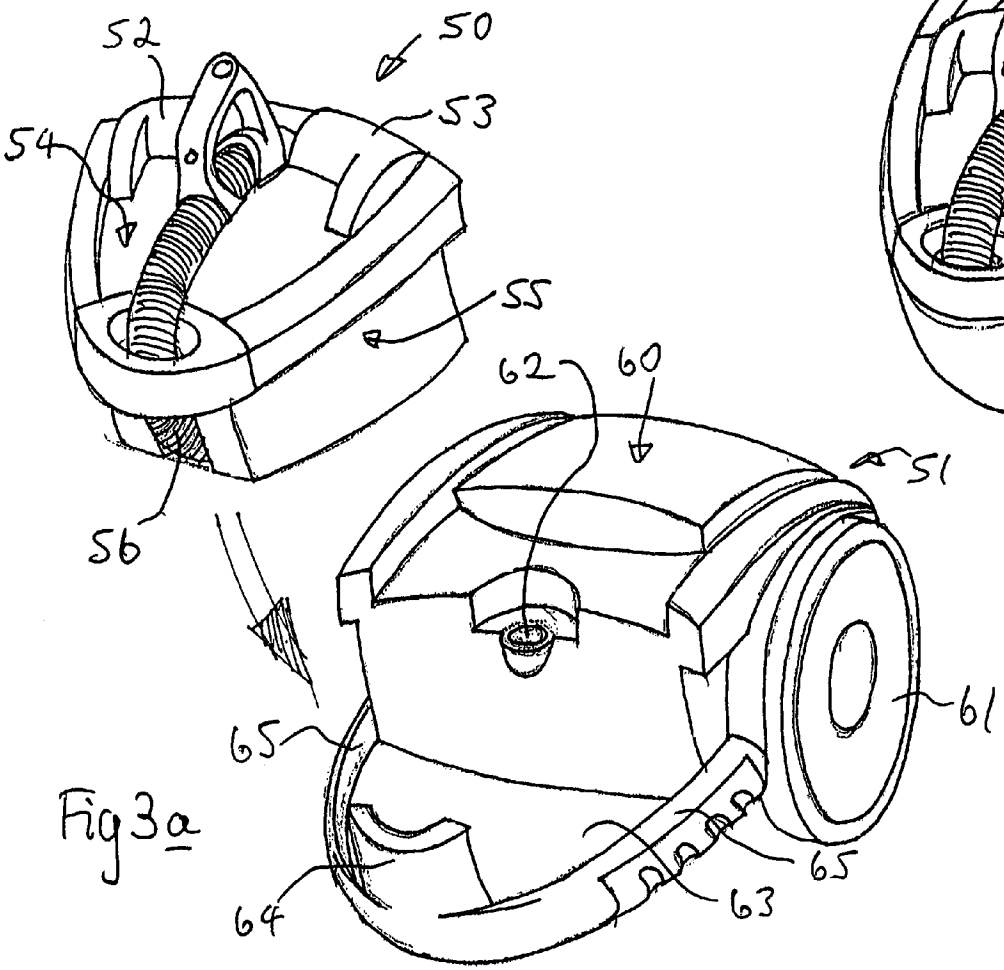

Referring now to FIG. 3 of the drawings this illustrates the use of a separator/collector assembly generally as above described, in relation to a suction cleaner. FIG. 3*a* shows the separator/collector assembly, indicated generally at 50, positioned above a suction cleaner body indicated generally at 51. The separator/collector assembly 50 is similar to that above described in relation to FIGS. 1 and 2 in that it comprises cyclonic separators 52, 53, like the separators 25, 26, arranged to discharge separated dust into respective box-like dust receiving parts indicated generally at 54, 55 between which there is a space in which a hose 56 is largely accommodated and from which the hose can be deployed. The separator/collector assembly 50 differs from that of FIGS. 1 and 2 in that in plan view it is tapered from its end at which the cyclonic separators are provided to its opposite end, with curved sides so as to fit in with the overall styling of the suction cleaner.

The body 51 of the suction cleaner comprises a rear body part indicated generally at 60 and having ground-engaging wheels one at each side, one such wheel being visible at 61. The body part 60 contains a source of suction for the cleaner namely an electric motor and impeller/fan, together with any required pre- and post-motor filters for removing any dust particles not separated by the separator/collector assembly 50 from the air flow respectively to the source of suction and released to the atmosphere from the source of suction. The body part 60 also affords or contains any required ones of features commonly found in association with the source of suction of a vacuum cleaner, for example (but not limited to) an on/off switch, storage space for cleaning tools or parts, and a storage facility such as a rotatable drum or reel on which an electrical power supply cable can be stored, deployed as required, and rewound thereto after use of the cleaner has ended. Also visible in the body part 60 of the cleaner is a passage 62 which leads to the source of the suction and which co-operates with the outlet for suction airflow from the cyclonic separators 52, 53 of the separator/collector assembly when the later is fitted to the body part of the cleaner.

The cleaner body further comprises a forward part in the form of a platform 63 with an upstanding front wall portion 64 and side wall portions 65 of lesser height than the front wall portion. These define a recess in which the separator/collector assembly 50 is able to be closely accommodated with its air flow outlet engaging the inlet to the passage 62 leading to the source of suction. Beneath the platform 63 a further wheel or wheels, e.g. a castor assembly, would be provided so that the cleaner can easily be pulled over a floor surface by its hose 56 when in use.

FIG. 3*b* shows the cleaner with the separator/collector assembly in-situ in relation to the body of the cleaner. The cleaner is compact to facilitate easy storage thereof when not in use, but the hose can be deployed therefrom for use in the usual manner of a suction cleaner of the "cylinder" type. If a cleaner of "wet" type were required to be provided, this could be achieved by substitution of an appropriate alternative separator/collector assembly.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

What is claimed is:

1. A separator/collector assembly removably connected with a body of a suction cleaner, the assembly comprising a storage volume for a suction hose that can be deployed from the assembly for use when required, wherein the hose is extendable lengthways when subject to lengthways tension, wherein the hose is able to be substantially entirely accommodated in the storage volume provided in the assembly when the hose is in a non-extended position, and wherein the hose is accommodated in the storage volume in a generally sinuous configuration when the hose is in the non-extended position.

2. The separator/collector assembly of claim 1 wherein the storage volume is formed in a mid-region of the assembly, and dust receiving volumes are provided on opposite sides of the storage volume to provide for collection of dust.

3. A separator/collector assembly removably connected with a body of a suction cleaner, the assembly comprising a storage volume for a suction hose that can be deployed from the assembly for use when required, wherein the hose is extendable lengthways when subject to lengthways tension, and wherein the hose is able to be substantially entirely accommodated in the storage volume provided in the assembly when the hose is in a non-extended position, the assembly including a guide such that when the hose is in the non-extended position the hose assumes a generally S-shaped configuration in the storage volume.

4. The separator/collector assembly of claim 3 wherein the guide comprises an arm including a plurality of spaced formations around which the hose assumes the generally S-shaped configuration.

5. The separator/collector assembly of claim 4 wherein the arm is spring biased to pivot it so as to cause the hose to assume the generally S-shaped configuration.

6. The separator/collector assembly of claim 4 wherein the plurality of formations on the arm comprise a plurality of rollers.

7. A separator/collector assembly removably connected with a body of a suction cleaner, the assembly comprising a storage volume for a suction hose that can be deployed from the assembly for use when required and at least one cyclonic separating device operatively connected to an end of the suction hose, wherein the hose is extendable lengthways when subject to lengthways tension.

8. The separator/collector assembly of claim 7 further comprising a second cyclonic separating device, wherein the first and second cyclonic separating devices are connected in parallel with one another.

9. The separator/collector assembly of claim 8 wherein the first and second cyclonic separating devices discharge separated dust to a respective dust collection space on either side of the storage volume in the assembly.

10. A suction cleaner comprising:

A body including a motor to provide a source of suction, and a separator/collector assembly removeably installed on the body and comprising a suction hose that may be selectively positioned in an extended position for use and a substantially non-extended position for storage, and a cavity for receiving the suction hose in the substantially non-extended position, wherein the separator/collector assembly further comprises a cyclonic separating device connected to a non-extend end of the suction hose and connectable to an inlet aperture in the body for fluidly connecting the source of suction to the non-extending end of the suction hose.

11. The suction cleaner of claim 10 wherein the cyclonic separating device comprises a plurality of cyclonic separators providing a plurality of flow paths from the suction hose to the body.

12. The suction cleaner of claim 10 wherein the separator collector assembly further comprises a dust receiving part for collection of dust or debris flowing through the suction hose.

13. A suction cleaner comprising:

a body including a motor to provide a source of suction, and a separator/collector assembly removably installed on the body and comprising a suction hose that may be selectively positioned in an extended position for use and a substantially non-extended position for storage, and a cavity for receiving the suction hose in the substantially non-extended position, wherein the separator/collector further comprises an arm for causing the suction hose to assume a generally S-shaped configuration when in the substantially non-extended position.

14. A suction cleaner comprising:

a body including a motor to provide a source of suction, and a separator/collector assembly removably installed on the body and comprising a suction hose that may be selectively positioned in an extended position for use and a substantially non-extended position for storage. and a cavity for receiving the suction hose in the substantially non-extended position, wherein the separator/collector further comprises a plurality of guide rollers that are pivotally connected by a movable arm to the separator/collector to place the suction hose in a generally sinuous configuration when the hose is positioned in the substantially non-extended position.

* * * * *

UNITED STATES PATENT AND TRADEMARK OFFICE

CERTIFICATE OF CORRECTION

PATENT NO. : 7,553,347 B2
APPLICATION NO. : 11/375722
DATED : March 15, 2006
INVENTOR(S) : Gavin Burnham It is certified that error appears in the above-identified patent and that said Letters Patent is hereby corrected as shown below:

Column 6, Claim 10, line 26, "connected to a non-extend end" should be --connected to a non-extending end--.

Signed and Sealed this

Sixteenth Day of March, 2010

David J. Kappos

David J. Kappos
*Director of the United States Patent and Trademark Office*